US005791240A

United States Patent [19]

Yagi et al.

[11] Patent Number: 5,791,240

[45] Date of Patent: Aug. 11, 1998

[54] SLIDE DEVICE IN MECHANICAL PRESS

[75] Inventors: Takashi Yagi; Mitsuo Sato, both of Sagamihara, Japan

[73] Assignee: Aida Engineering Ltd., Kanagawa-ken, Japan

[21] Appl. No.: 514,571

[22] Filed: Aug. 14, 1995

[30] Foreign Application Priority Data

Oct. 13, 1994 [JP] Japan ..... 6-274539

[51] Int. Cl.[6] ..... B30B 15/00

[52] U.S. Cl. ..... 100/257; 100/282

[58] Field of Search ..... 100/257, 282, 100/292

[56] References Cited

U.S. PATENT DOCUMENTS

| | | | |
|---|---|---|---|
| 4,166,415 | 9/1979 | Spanke et al. | 100/257 |
| 4,823,687 | 4/1989 | Yonezawa et al. | 100/257 |
| 5,349,902 | 9/1994 | Daniel et al. | 100/257 |

FOREIGN PATENT DOCUMENTS

| | | | |
|---|---|---|---|
| 47-33111 | 11/1971 | Japan | 100/257 |
| 63-76800 | 4/1988 | Japan | 100/257 |
| 4-112000 | 4/1992 | Japan | 100/257 |

*Primary Examiner*—Stephen F. Gerrity

*Attorney, Agent, or Firm*—Wood, Phillips, VanSanten, Clark & Mortimer

[57] ABSTRACT

A screw mechanism is used to change the shut height of a mechanical press. A clearance between thread faces of a female screw and a male screw in this screw mechanism is shifted to one of the thread faces, on which an operating load of the press acts, by pressing the other thread face, which receives the operating load, by the action of a hydraulic force from a hydraulic cylinder mechanism, by which the clearance is always positioned on the side of one thread face. Since the female and male screws cannot rotate relatively and put in a lock state while the thread faces are pressed to one side, the position of a slide does not change even if the press is driven in this state. A hydraulic cylinder for quick die opening is provided separate from a hydraulic cylinder for locking the female and male screws in the shut height adjustment, by which the slide is moved upward or downward. This achieves a quick die opening mechanism used for maintenance and checks of the press which maintains a sufficient and constant upward stroke length of the slide even though the shut height changes.

2 Claims, 5 Drawing Sheets

SLIDE DEVICE IN MECHANICAL PRESS

BACKGROUND OF THE INVENTION

1. Field of the Invention

The present invention relates to a mechanical press, and more particularly, to improvements in a slide adjustment mechanism for adjusting the shut height and a quick die opening mechanism used for maintenance and checks of a die held attached to a mechanical press.

2. Description of the Related Art

The slide adjustment to change the shut height is normally made by changing the length of engagement of a female screw and a male screw, and therefore, a clearance needs to be formed in an engaging portion between the female and male screws.

However, since a slide freely moves in the vertical direction by an amount corresponding to the clearance between the screws, the position of the slide changes. This positional change of the slide lowers the accuracy of stamped parts, and further hastens the deterioration of a die.

Another type of mechanical press, in which the stroke length of a slide is short, is difficult to be subjected to maintenance and checks in a state where a die is held attached thereto even though the slide is raised to the top dead center.

In order to solve these problems, the prior art shown in FIG. 5 has the following structure. A piston rod 7 is coupled to a connecting rod, which is not shown, at the top thereof and slidably fitted in a male screw member 17 at the bottom thereof. A rotatable female screw member 9 is mounted on a slide 16 such that it cannot move vertically, and a piston portion 7A of the piston rod 7 is located in a hydraulic cylinder 31 mounted on the slide 16, thereby constituting a hydraulic cylinder device.

In the above-mentioned structure, an upward-acting hydraulic force is exerted on the piston rod 7 by supplying pressure oil into a hydraulic chamber 32 to lift up the male screw member 17. A clearance between thread faces of a male screw of the male screw member 17 and a female screw of the female screw member 9 is thereby shifted to one side and the screws are locked, so that the clearance between the thread faces has no influence on stamping. A stamping operation is carried out in this state.

Maintenance and checks of a die or adjustment of the shut height is performed in a state in which the slide is put in the upper position by discharging the pressure oil from the hydraulic chamber 32.

The above mechanism doubles as a slide adjustment mechanism for changing the shut height and a quick die opening mechanism for moving a slide vertically, and further serves to lock screws in the slide adjustment.

However, in the slide adjustment mechanism of the prior art, there is a clearance on the thread face side which receives an operating load acting on the slide 16, and the operating load is supplied from the hydraulic force of the hydraulic chamber 32. If the operating load acts in this state, the oil in the hydraulic chamber 32 is compressed under pressure, by which the volume thereof decreases. This decrease in volume changes the position of the slide 16.

Furthermore, since the slide adjustment for changing the shut height is made by changing the vertical positions of the male screw member 17 and the female screw member 9, that is, the length of engagement thereof, the male screw member 17 functioning as a stopper for the piston rod 7 is moved vertically relative to the slide 16 by the slide adjustment, and thereby, a stroke length L1 for quick die opening changes.

Still furthermore, since the shut height can be adjusted only in a quick die opening state, workability is poor.

SUMMARY OF THE INVENTION

It is therefore an object of the present invention to solve the above-mentioned problems of the prior art.

In order to achieve the above object, a slide device in a mechanical press according to the present invention has the following features:

(a) The shut height is controlled by a slide adjustment mechanism using a screw mechanism in a similar manner to the prior art. A hydraulic force is exerted on one of thread faces of a female screw and a male screw in the screw mechanism, which receives an operating load of the press, by a hydraulic cylinder mechanism, so that the clearance between the female and male screws is shifted to the side of the other thread face on which the operating load acts. The clearance between the female and male screws is thereby always shifted on the side of one thread face. Furthermore, since the slide adjustment mechanism fixes the female and male screws against relative rotation and puts the screws in a lock state while one thread face is being pressed against the other thread face, it is possible to drive the press without changing the position of a slide.

(b) A hydraulic cylinder for quick die opening is provided, separate from a hydraulic cylinder for locking the female and male screws for slide adjustment, to move the slide upward or downward. This achieves a quick die opening mechanism used for maintenance and checks of the press which is not affected by the slide adjustment and maintains a sufficient and constant upward stroke length of the slide.

More specifically, according to the present invention, there is provided a slide device in a mechanical press which vertically moves a slide through a connecting rod by rotating a crank shaft and has a slide adjustment device, the slide adjustment device comprising a hydraulic cylinder device acting between the connecting rod and the slide and having a hydraulic cylinder body; a slide adjustment mechanism including a male screw located on the outer periphery at the bottom of the hydraulic cylinder body and a female screw member with a female screw in meshing engagement with the male screw, the female screw member being fixed against vertical movement and rotatable relative to the slide; a cylindrical member fitted on the outer periphery of the hydraulic cylinder body and coupled to the slide; a hydraulic chamber formed by the hydraulic cylinder body and the cylindrical member; and a pressure oil supply means for supplying or discharging pressure oil to or from the hydraulic chamber, and for pressing the male screw against the female screw in the axial direction and locking the male and female screws by supplying the pressure oil to the hydraulic chamber.

DETAILED DESCRIPTION OF THE PREFERRED EMBODIMENT

Figure 1:
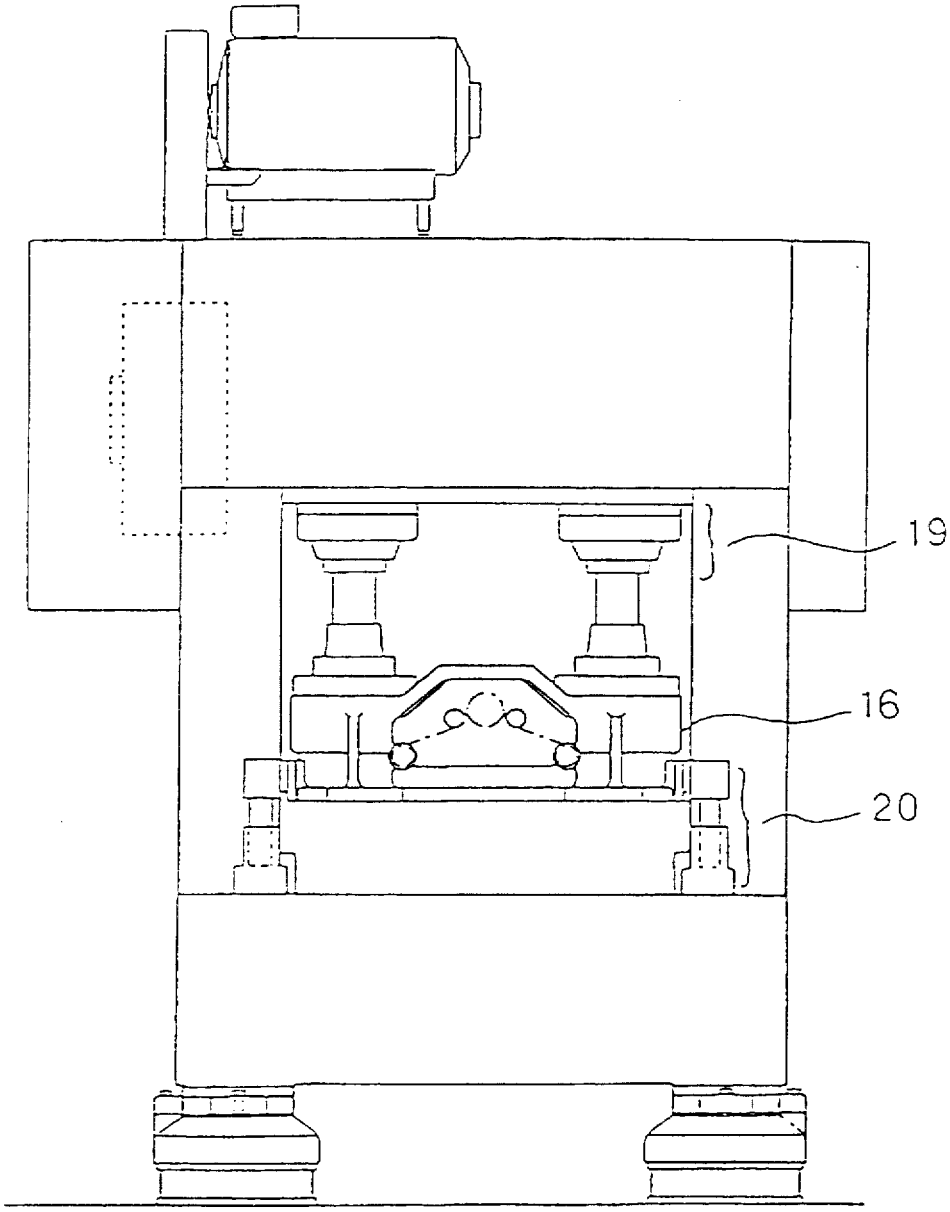
FIG. 1 is a front view of a mechanical press to which a slide device of the present invention is applied.
Figure 2:
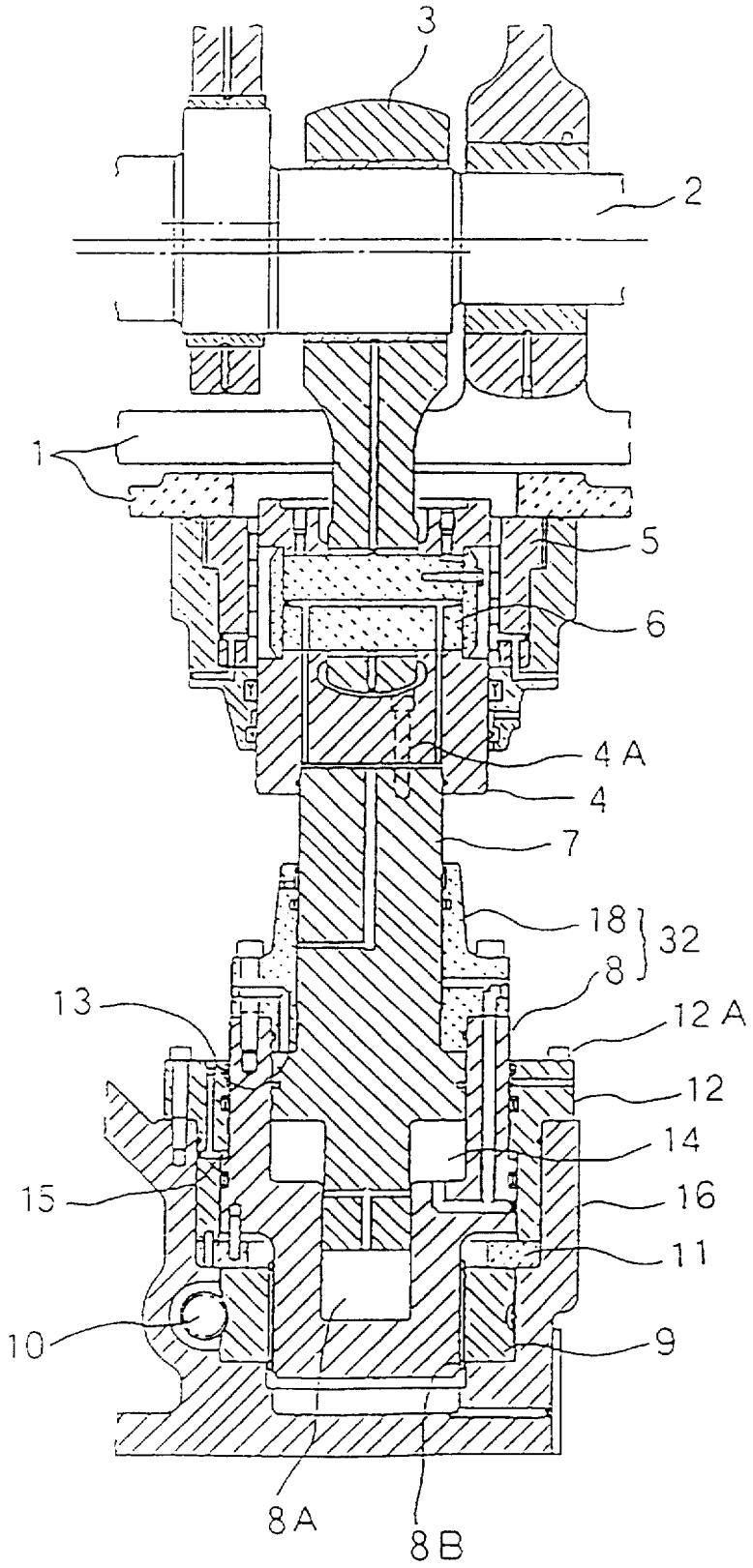
FIG. 2 is a cross sectional view showing the principal part of FIG. 1.

A slide device in a mechanical press according to the present invention has the following structure.

A hydraulic cylinder is provided between a connecting rod and a slide. A piston rod as a component of the hydraulic cylinder is coupled to the connecting rod through a coupling member at the top thereof, and guided movably in the vertical direction by both a cylinder head and a cylindrical hole respectively formed at the top and bottom of a hydraulic cylinder body.

A male screw is formed around the bottom end of the hydraulic cylinder body, and constitutes a slide adjustment mechanism in combination with a rotatable female screw member mounted on the slide and fixed against vertical movement.

A cylindrical member fixed to the slide is fitted on the hydraulic cylinder body to form a hydraulic chamber therebetween. A clearance in an engaging portion between male and female screws is shifted to one side and the screws are locked by acting pressure oil on the hydraulic chamber.

An embodiment of the present invention will be described below with reference to FIGS. 1, 2, 3 and 4.

A slide 16 is guided by an upper guide device 19 and a post guide 20 such that it can move not horizontally, but vertically. A connecting rod 3 is coupled to a crank shaft 2, and to a coupling member 4 through a wrist pin 6 at the bottom thereof. The coupling member 4 is vertically guided by a guide member 5 mounted on a crown 1. The guide member 5 and the coupling member 4 constitute the aforesaid upper guide member 19. The coupling member 4 is connected to the top of an upward-pointing piston rod 7 in a hydraulic cylinder device 32 by a bolt 4A. The piston rod 7 is guided movably in the vertical direction by a cylinder head 18 and a cylindrical hole 8A formed at the bottom of a hydraulic cylinder body 8, thereby constituting the hydraulic cylinder device 32. First and second hydraulic chambers 13 and 14 are respectively formed on and under a piston portion 7A of the piston rod 7. A cylindrical member 12 is fitted on the outer periphery of the hydraulic cylinder body 8, between which a third hydraulic chamber 15 is formed, and joined to the slide 16 by bolts 12A.

A male screw portion 8B formed at the bottom of the hydraulic cylinder body 8 is screwed in a female screw 9A of a female screw member 9, thereby constituting a slide adjustment mechanism for changing the position of the slide. 16. The female screw member 9 is rotatably fitted in the slide 16 and the vertical movement thereof is limited by a presser plate 11.

A quick die opening mechanism is operated as follows by a hydraulic circuit which supplies and discharges pressure oil for driving the hydraulic cylinder device 32.

(a) When a quick die opening diverter valve 25 is switched to a side 25A, pressure oil in the first hydraulic chamber 13 is discharged, pressure oil is supplied to the second hydraulic chamber 14, and the piston rod 7 is urged upward by the hydraulic force and moved to the uppermost position, which moves the slide 16 downward and allows a stamping operation.

(b) When the quick die opening diverter valve 25 is switched to a side 25C to the contrary, pressure oil is supplied to the first hydraulic chamber 13 and pressure oil in the second hydraulic chamber 14 is discharged. The piston rod 7 moves to the lowermost position, and the slide 16 moves upward, thereby bringing about a quick die opening state.

The shut height is controlled in the following manner.

(c) After a slide lock diverter valve 26 is switched to a side 26A and pressure oil in the third hydraulic chamber 15 is discharged, the female screw member 9 is rotated to move the hydraulic cylinder body 8 only by the required amount in the upward or downward direction.

Figure 3:
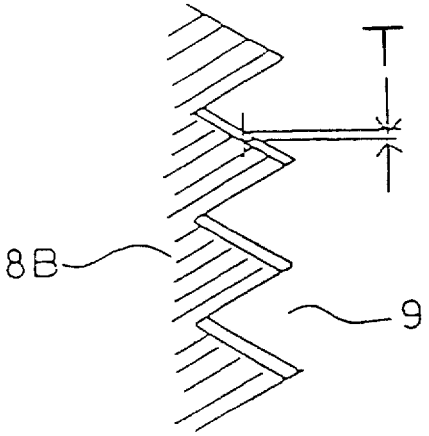
FIG. 3 is a detailed view of a screw engaging portion shown in FIG. 2 when pressure oil is acted on a third hydraulic chamber.
Figure 4:
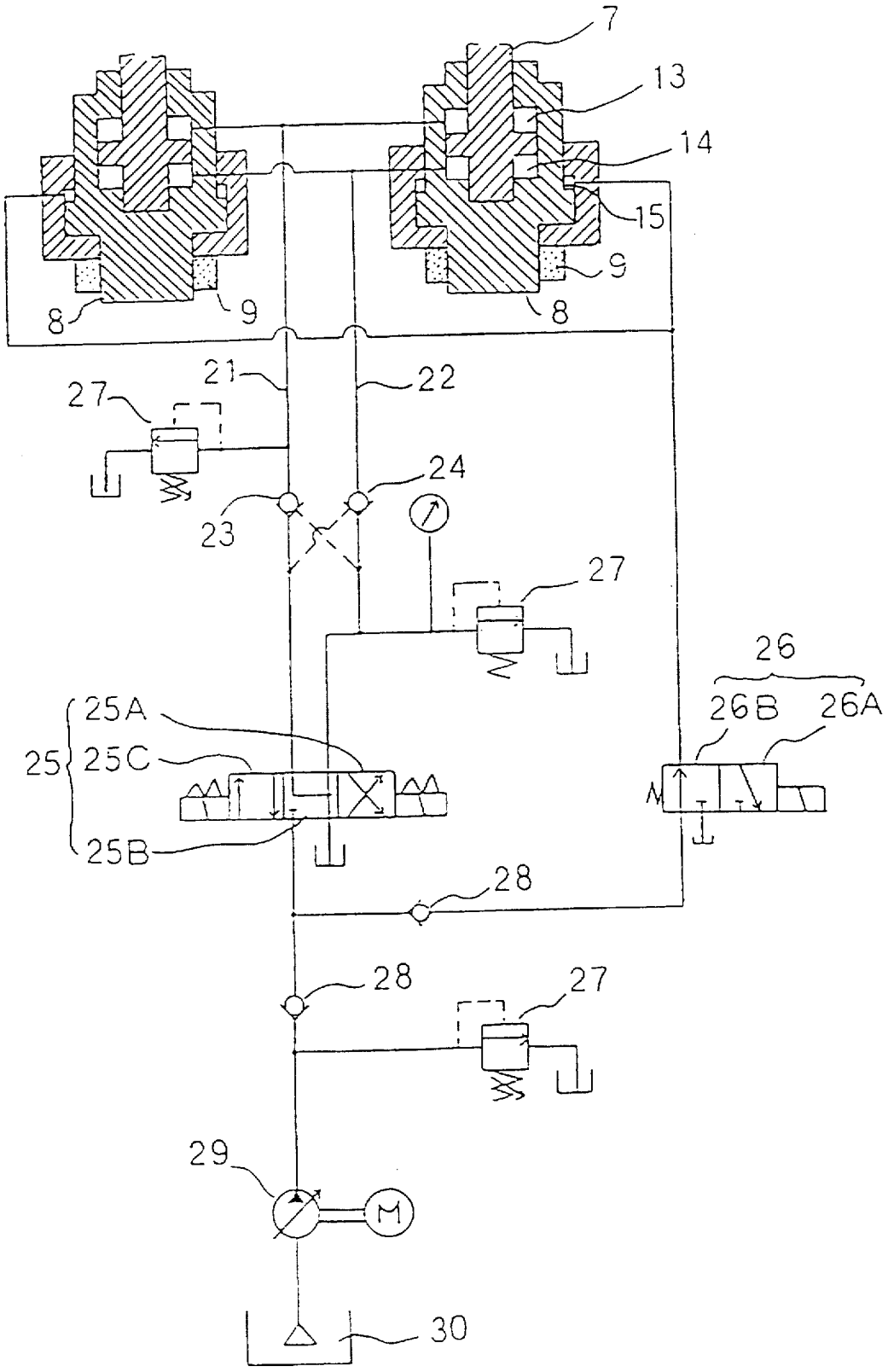
FIG. 4 is a diagram of a hydraulic circuit for supplying pressure oil to a hydraulic cylinder shown in FIG. 2.
Figure 5:
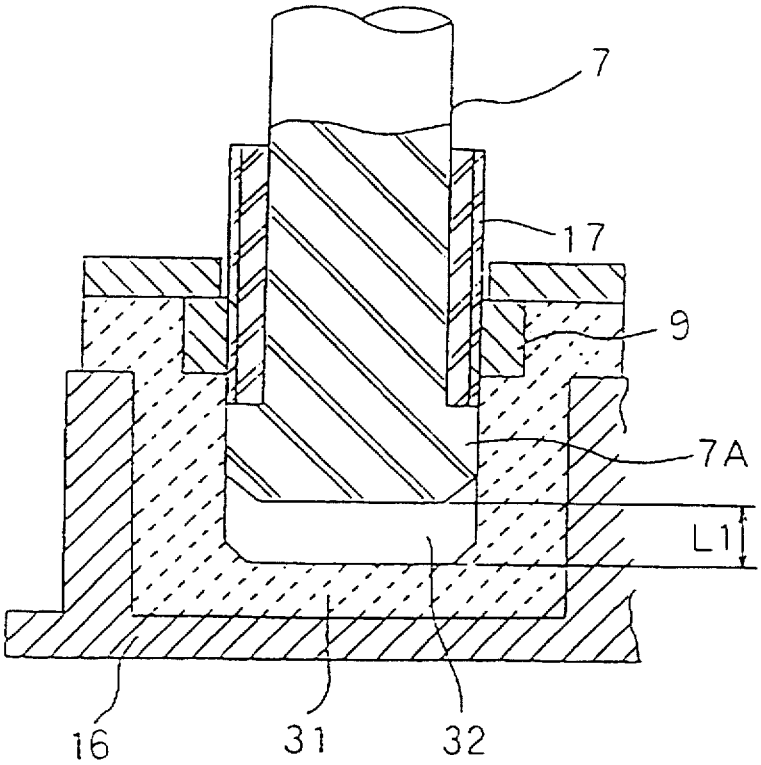
FIG. 5 PRIOR ART
FIG. 5 is an explanatory view of the prior art.

(d) After the change of the shut height is completed, the diverter valve 26 is switched to a side 26B, a clearance T in a screw engaging portion between the female screw member 9 and the male screw 8A is shifted to one side and locked by a hydraulic force as shown in FIG. 3.

Although a single hydraulic cylinder doubles as a quick die opening mechanism and a lock mechanism for slide adjustment in the prior art, hydraulic cylinders are provided for the respective mechanisms in the present invention as mentioned above. Therefore, since the quick die opening stroke length does not change even if the shut height is changed, maintenance and checks are easily performed. Furthermore, an easy slide adjustment is allowed even when the slide is down or in the quick die opening state.

What is claimed is:

1. A slide device in a mechanical press for vertically moving a slide through a connecting rod by rotating a crank shaft, which has a slide adjustment device, the slide adjustment device comprising:

a hydraulic cylinder device acting between said connecting rod and said slide and having a hydraulic cylinder body;

a slide adjustment mechanism including a male screw located on the outer periphery at the bottom of said hydraulic cylinder body and a female screw member with a female screw in meshing engagement with said male screw, said female screw member being fixed against vertical movement and rotatable relative to said slide;

a cylindrical member fitted on the outer periphery of said hydraulic cylinder body and coupled to said slide;

a hydraulic chamber formed by said hydraulic cylinder body and said cylindrical member; and pressure oil supply means for supplying or discharging pressure oil to or from said hydraulic chamber, and for pressing said male screw against said female screw in the axial direction and locking said male and female screws by supplying the pressure oil to said hydraulic chamber.

2. A slide device in a mechanical press according to claim 1, wherein a piston rod as a component of said hydraulic cylinder device is coupled to said connecting rod through a coupling member fixed to the top thereof, the upper limit of the vertical stroke of said piston rod is determined by a cylinder head fixed at the top of said hydraulic cylinder body, and the lower limit is determined by a bottom plate of said hydraulic cylinder body, an outer surface of a piston portion in the middle of said piston rod and a cylindrical portion under said piston portion of said piston rod are respectively guided in the vertical direction by a cylinder inner portion of said hydraulic cylinder body and a cylindrical hole portion under said cylinder inner portion, said piston rod is made movable downward or upward relative to said hydraulic cylinder body by supplying or discharging pressure oil to or from an upper hydraulic chamber or a lower hydraulic chamber respectively formed in an upper portion or a lower portion of said hydraulic cylinder body, and said slide is moved vertically by supplying or discharging pressure oil to or from said upper and lower hydraulic chambers.

* * * * *